US006695710B2

(12) United States Patent
Yamada

(10) Patent No.: US 6,695,710 B2
(45) Date of Patent: Feb. 24, 2004

(54) GOLF PUTTING SWING DEVICE AND METHOD OF USING THE SAME

(75) Inventor: Megumi Yamada, Saitama (JP)

(73) Assignee: Graphite Design International Incorporation (JP)

( * ) Notice: Subject to any disclaimer, the term of this patent is extended or adjusted under 35 U.S.C. 154(b) by 0 days.

(21) Appl. No.: 10/207,514

(22) Filed: Jul. 29, 2002

(65) Prior Publication Data

US 2003/0027657 A1 Feb. 6, 2003

(30) Foreign Application Priority Data

Aug. 3, 2001 (JP) ..... 2001-5119

(51) Int. Cl.[7] ..... A63B 53/06
(52) U.S. Cl. ..... 473/265
(58) Field of Search ..... 473/265, 264, 473/218, 219, 238, 257, 261, 266, 268, 269, 273, 491, 492, 493, 494, 495, 496

(56) References Cited

U.S. PATENT DOCUMENTS 2,869,875 A * 1/1959 Steenson ..... 473/170
3,485,497 A * 12/1969 Wilks ..... 473/267
3,656,752 A * 4/1972 Moriarty ..... 473/261
3,806,133 A * 4/1974 Cork ..... 473/258
5,039,105 A * 8/1991 Ro ..... 473/258
5,042,815 A * 8/1991 Sutton ..... 473/218
5,273,284 A * 12/1993 Montgomery ..... 473/258
5,407,178 A * 4/1995 Long ..... 256/45
5,624,326 A * 4/1997 Hohl et al. ..... 473/176
5,897,439 A * 4/1999 Hohl et al. ..... 473/176
5,913,732 A * 6/1999 Kwakkel ..... 473/267
6,007,438 A * 12/1999 Harrell ..... 473/496
6,048,273 A * 4/2000 Clement ..... 473/261

* cited by examiner

*Primary Examiner*—Paul T. Sewell
*Assistant Examiner*—Nini F. Legesse
(74) *Attorney, Agent, or Firm*—Daniel L. Dawes; Myers Dawes Andras & Sherman LLP

(57) ABSTRACT

The training device is comprised of two vertically mounted separated rods, which are connected by two strings. The vertically erected rods have two component structures, namely a base rod subsection and a height adjustable rod subsection. Each rod comes with a rotatable hook that can be mounted in slits to hook to the two strings. The rods are equipped with a bubble level on their top to adjust for a perpendicular mounting position. The ball is placed on the ground immediately under the lower one of two strings which serve as a sightline by which the direction of the swing of the putter is defined and to which the striking face of the putter is perpendicularly maintained.

13 Claims, 3 Drawing Sheets

FIG. 4
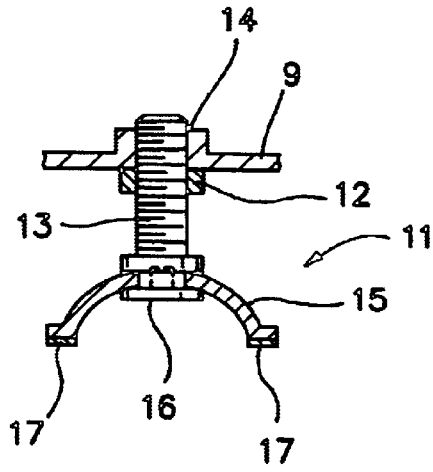
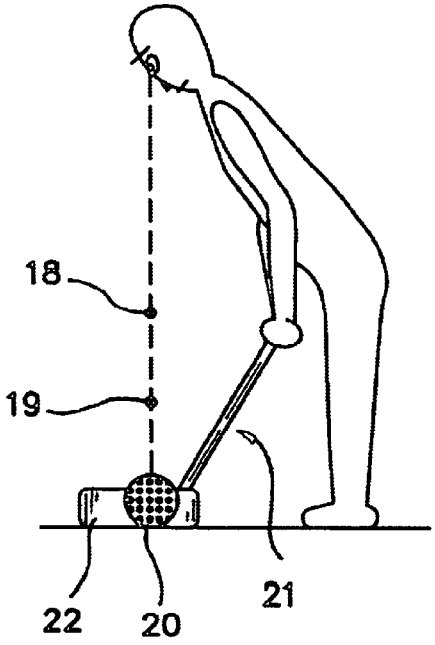
FIG. 5
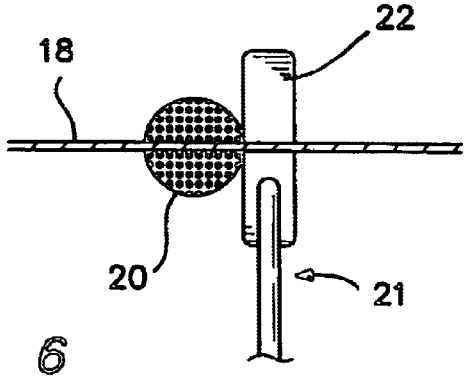
FIG. 6

GOLF PUTTING SWING DEVICE AND METHOD OF USING THE SAME

RELATED APPLICATIONS

The present application is related to and claims priority from Japanese Model Patent Application serial no. 2001-5119, filed on Aug. 3, 2001 pursuant to 35 USC 119.

BACKGROUND OF THE INVENTION

1. Field of the Invention

The invention relates to the field of golf equipment and training methods, and in particular to a putting practice device that is independent of any attached physical aid to improve swing direction and face angle of the putter.

2. Description of the Prior Art

For a proper swing of a golf putter, it is important to look from directly above the golf ball. It is important for the player to align his or her body toward target direction and make face of the putter perpendicular to the direction of the target. Up to this time, this practice could be done anywhere, which includes outside and inside of a home or office in many cases. For this type of practice, it is common to practice on an artificial lawn with a hole that is arranged in direction of the target or hole. However, in many cases, the player has never achieved the correct putting swing form, since they were able to practice only on their own uncorrected putting style.

A number of such practice devices have been proposed in the past. For example, in Japanese Provisional Publication No. 11-89989 two height adjustable poles were set up and horizontally connected by one rod with a sliding bracket, which will hold the putter vertically and horizontally at 90 degrees. The device disclosed in Japanese Provisional Publication No. 11-89989 creates the habit of depending on device since it comes with a swing and face angle support member. If the player abandons the practice device, the player's putting form returns back to what it was when the player started. This device similarly creates the bad habit of dependence on the practice device as well.

In Japanese Provisional Publication No. 11-28263 a U-shaped device with a putter guiding roller on each side is provided. The roller will guide the putter toward the target as the player takes the stroke.

In Japanese Provisional Publication No. 7-275426 a U-shaped device with electric sensor on the side or bottom of the device is provided. Such side sensor will detect an incorrect direction of the player's putting swing. Another sensor on the bottom of will detect any incorrect face angle of the player's putting swing. While this device does not tend to create a dependence on the practice equipment, the use of electric sensors is a cost problem.

In Japanese Provisional Publication No. 3030460 two rods are provided that are separated by some distance. These rods are connected with one bead ball, which passes through a string. The player practices by hitting the bead ball. The use of this device suffers from the disadvantage that the player can not practice with a real golf ball, which makes it harder for the player to practice the correct putting stroke.

Therefore, what is needed is some type of device or methodology, which is not limited by the foregoing types of defects of the prior art putting training devices and methods.

BRIEF SUMMARY OF THE INVENTION

The idea of the invention is to provide inexpensive putting swing practicing device that does not rely on any physical aids or tools to improve swing direction and face angle of the putter. One characteristic of this device is to provide two vertically mounted separated poles that can be changed according to the player's needs, which rods are connected by two strings. The vertically mounted poles have two component structures, namely a base rod and a height adjustable rod. Each rod comes with a rotatable hook that can be mounted in slits to hook up the two strings. In addition, these rods are equipped with a bubble level on their tip to assist in perpendicularly positioning the rods. Alternatively, the bubble level is preferably mounted on a circular cone base that is part of the base rod.

The specifically, the invention is a training device for putting golf balls with a putter comprising a first pole and a second pole. Each pole is comprised of a top adjustable rod and a base rod. The top adjustable rod is telescopically coupled to the base rod. A pair of hooks is coupled to each pole in a spaced relationship. A top string is connected between one of the hooks of each pair of hooks coupled to each pole and extends between the first and second poles when the first and second poles are position in a separated configuration from each other. A bottom string is connected between the other one of the hooks of each pair of hooks coupled to each pole and extends between the first and second poles when the first and second poles are position in a separated configuration from each other. The bottom string is positioned above the ground and above a golf ball placed on the ground. The top string is positioned above the bottom string to provide a sighting line between the top and bottom strings to define the line of swing of the putter and a line perpendicular to the striking face of the putter. The first and second poles are vertically aligned with respect to the ground.

Each of the hooks are rotatably coupled to their corresponding poles so that the line of the top and bottom strings connected to the hooks extends through the center of the first and second poles.

The training device further comprises a base assembly coupled to the base rod. The base assembly provides support for the corresponding pole and in one embodiment meant to be used on hard flooring has an opening diametrically extending through the base assembly to allow free passage of the golf ball therethrough. The base assembly is comprised of a plinth coupled to the base rod and a plurality of legs coupled to the base rod. The opening is diametrically defined through the plinth and straddled by the legs.

The training device further comprises a bubble level coupled to each pole to facilitate vertical alignment of each pole.

In another embodiment the training device further comprises a base assembly coupled to the base rod for staking the pole to the ground.

In still another embodiment the training device further comprises a plurality of adjusting rods coupled to the base assembly for orienting the base assembly with respect to the ground.

The training device further comprises a scale defined on each top adjustable rod to permit repeatable height adjust of the first and second poles.

It must further be understood that the first and second poles may be fixed, nonadjustable rods or may be telescopic, adjustable rods.

Thus, the invention is also defined as a method of using a training device for putting golf balls with a putter, the putter having a striking face, comprising the steps of vertically erecting a first pole, vertically erecting a second pole, and connecting a top and bottom string between a pair of hooks rotatably coupled to each pole in a spaced relationship on the pole. The top string is connected between one of the rotatable hooks of each pair of rotatable hooks coupled to each pole and extends between the first and second poles when the first and second poles are position in a separated configuration from each other. The bottom string is connected between the other one of the rotatable hooks of each pair of rotatable hooks coupled to each pole and extends between the first and second poles when the first and second poles are position in a separated configuration from each other. The bottom string is positioned above the ground and above a golf ball placed on the ground. The top string is positioned above the bottom string. Corresponding pairs of the rotatable hooks rotate on the poles so that the line of the top and bottom strings connected to the hooks extends through the center of the first and second poles. The player sights along the top and bottom strings with the ball positioned in the sight line of the top and bottom strings. The player then swings the putter along the line of sight while holding the striking face of the putter perpendicular to the line of sight to strike the golf ball.

The method further comprises the steps of repeating the steps of sighting and swinging while holding the striking face of the putter perpendicular to the line of sight to strike the golf ball until the steps can be repeated without use of the top and bottom strings.

The method further comprises the step of adjusting the height of the top string relative to the bottom string by adjusting telescopic, adjustable rods comprising the first and second poles.

In one embodiment the method further comprises using a base assembly coupled to the bottom end of each pole for staking the pole to the ground and striking the golf ball to strike one of the staked poles.

In still another embodiment the method further comprises using a base assembly, which includes an opening to allow passage of the golf ball therethrough and striking the golf ball to pass through the opening in the base assembly.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The invention can be better visualized by turning now to the following drawings wherein like elements are referenced by like numerals.

BRIEF DESCRIPTION OF THE DRAWINGS

FIG. 4 is an enlarged side plan view of the bottom of height adjustable legs on the circular cone base.

FIG. 5 is a diagram showing the swing practice posture used by a player for the putting swing device of the invention.

FIG. 6 is a diagram showing how the golf ball is properly hit using the putting swing device of the invention.

The invention and its various embodiments can now be better understood by turning to the following detailed description of the preferred embodiments which are presented as illustrated examples of the invention defined in the claims. It is expressly understood that the invention as defined by the claims may be broader than the illustrated embodiments described below.

DETAILED DESCRIPTION OF THE PREFERRED EMBODIMENTS

The training device is comprised of two vertically mounted separated rods, which are connected by two strings. The vertically erected rods have two component structures, namely a base rod subsection and a height adjustable rod subsection. Each rod comes with a rotatable hook that can be mounted in slits to hook to the two strings. The rods are equipped with a bubble level on their top to adjust for a perpendicular mounting position. The ball is placed on the ground immediately under the lower one of two strings which serve as a sightline by which the direction of the swing of the putter is defined and to which the striking face of the putter is perpendicularly maintained.

Figure 1:
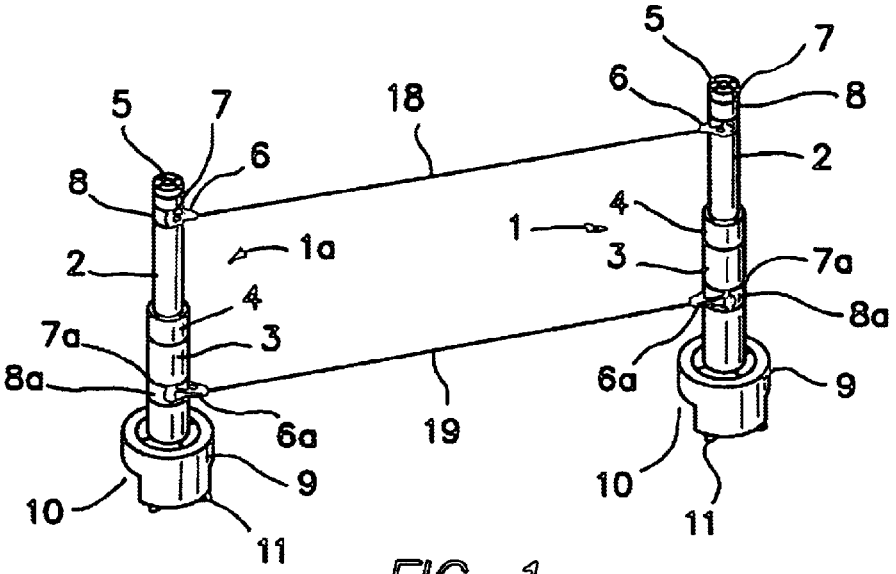
FIG. 1 is a perspective diagram of the putting swing device of the invention.

FIG. 1 illustrates a first of form of execution or use of the invention. Two poles, generally denoted by reference numerals 1 and 1*a*, have the same cylindrical form. Pole 1 and 1*a* are comprised of two component structures, namely a height adjustable rod 2 and a base rod 3 which both are constructed using circular pipe. Rigid, telescopic rods 2 and 3 are arranged so that the inner diameter of rod 3 and the outer diameter of rod 2 are the same or allow for a telescopic slip fit. A bolting ring 4 is used to fix rods 2 and 3 into a relative position. Such a telescopic fixation is conventional in the art and will not be further described.

Figure 2:
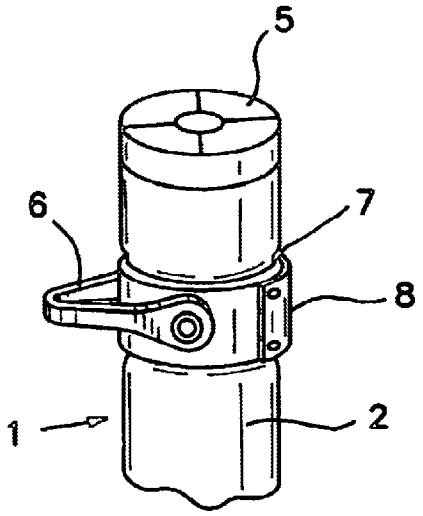
FIG. 2 is an enlarged perspective view of the top of one of the rods shown in FIG. 1.

Height adjustable rod 2 includes an engraved scale on its side allow for an accurate and repeatable height adjustment, bubble level meter 5 is used to check the perpendicularity of the mounting position, and a hook 6 is provided near the end of rod 2 as indicated in the enlarged view of FIG. 2. Hook 6 provides a rotational function realized by having a band 8 connected in slit 7, which also prevents band 8 from sliding off or out of rod 2.

Figure 3:
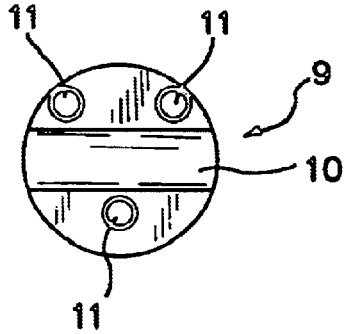
FIG. 3 is an enlarged bottom plan view of the circular cone base of FIG. 1.

Hook 6*a* is also mounted on center of base rod 3 and serves the same functions as hook 6 does, that is to connect band 8*a* to slit 7*a*. In addition to this, there is a plinth 9 mounted bellow the base rod 3. Below the plinth 9, there is diametrically extending hollowed section 10 to allow a golf ball to pass there through directly beneath rod 3. Also, in each side of this hollowed section 10, there are three height adjusting legs 11 as indicated in FIG. 3 to perpendicularly mount poles 1 and 1*a*. As indicated in FIG. 4, these height adjustable legs 11 are tightened down by first tightening nut 12 against plinth 9 which has threaded hole 14, then sliding the cup 15 below the nut 12 and tightening screw 16. Lastly, mat 17 protects the edges of the cup 15.

For poles 1 and 1*a*, upper string 18 connects to hook 6, which is mounted on height adjustable rod 2. The same structure can be viewed with lower string 19 which connects to hook 6*a*, which is mounted on base rod 3. Strings 18 and 19 is made from a material that does not stretch such a Dacron® over the length between the separated poles 1 and

1*a*. If upper string 18 and lower string 19 are made from rubber based material, it is easier to adjust the tension of the strings.

The first embodiment of this putting device is usually used indoors. The procedure for using this device is the following. First setup pole 1 and 1*a* on plinth 9 some distance apart from each other so a straight line can be established between them. Make sure hollowed section 10 of plinth 9 is align as well with the connecting straight line between poles 1 and 1*a*. The next step is to adjust the height of poles 1*a* and 1 with height adjustable rod 2 connected with base rod 3 of the engraved scale is handy for this height adjustment. The last step is hooking up the string 18 to rod 2 and string 19 to rod 3 by using pairs of hooks 6 and 6*a*. Prior to this last step, height adjustable leg 11 and bubble level meter 5 are used to make pole 1 and 1*a* perpendicular to the ground.

As shown in FIGS. 5 and 6, the golf ball 20 is set up under the upper string 18 and lower 19 string so that the player's eyes are vertically over the top both strings 18 and 19. The player should take the stroke by keeping the head 22 of putter 21 perpendicular to string 18. The golf ball should be struck so that it rolls toward and under hollowed section 10.

Figure 7:
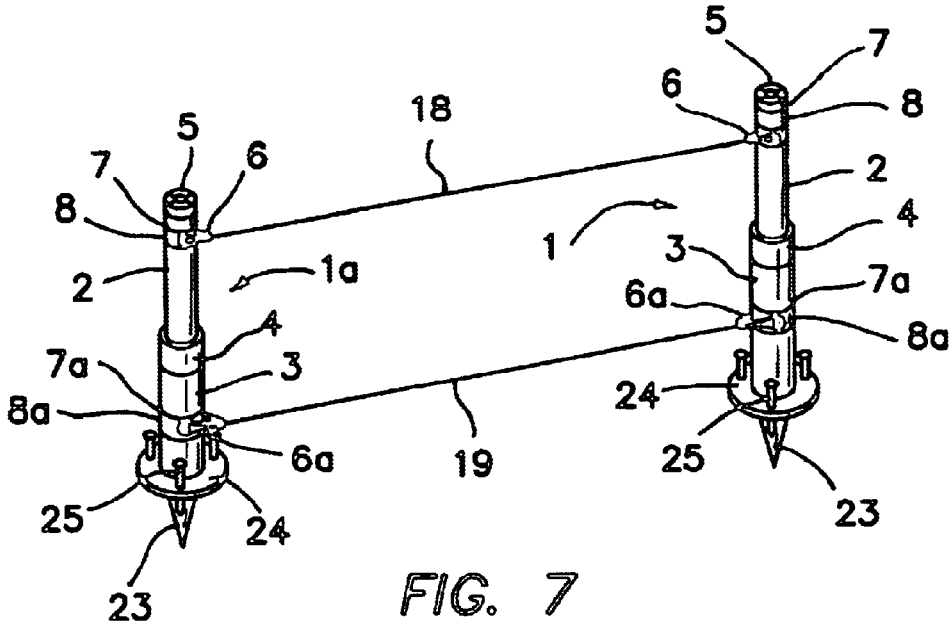
FIG. 7 is a perspective diagram of another embodiment of the swing practice device.

FIG. 7 is second embodiment of the putting device. Only the difference here is in a modification of plinth 9 from the first embodiment. Namely, instead of mounting a plinth 9 as in the first embodiment, the bottom tip of base rod 3 is mounted with circular bottom disk 24 that comes with ground stake 23. Stake 23 is meant to be put into the ground and the vertical-mounting position is adjusted by using bolt 25.

Figure 8:
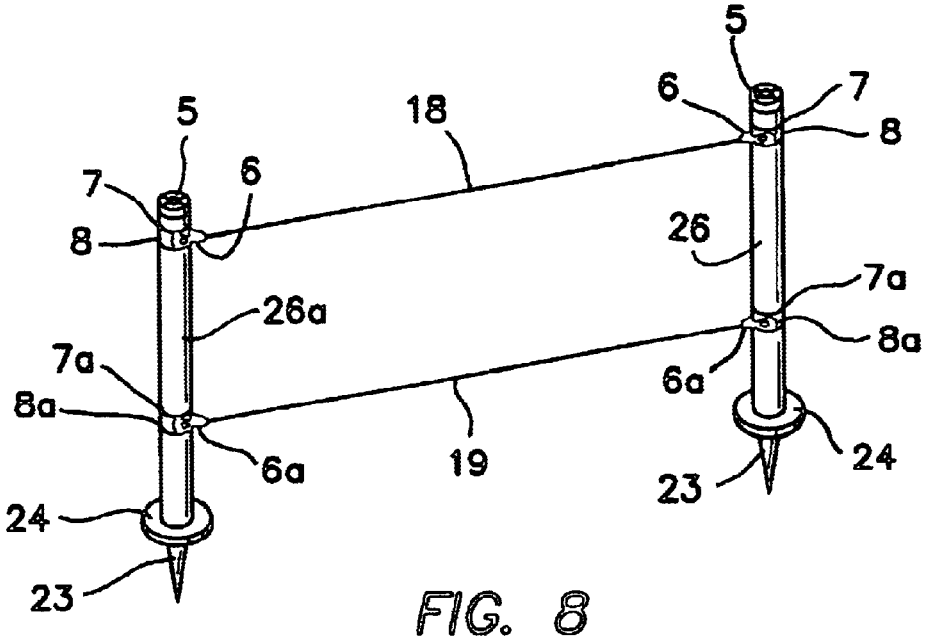
FIG. 8 is a perspective diagram of yet another embodiment of the swing practice device.

FIG. 8 is a third embodiment of the putting device. Poles 26 and 26*a* have the same cylindrical structure has a half-circle shaped hook 6 and 6*a* on top part of the rod and base rod. Hook 6 has same structure that was introduced in FIG. 2 of the first embodiment. Poles 26 and 26*a* have a built-in level meter on the top and have a circular bottom disk 24 with stake 23. This device can exist by inserting the stake 23 into the ground and adjusting the vertical position of the poles by using the level meters.

In summary, the invention uses two vertically mounted poles that are separated in some distance. After overlapping one string on top and bottom part of the poles, the strings are aligned in direction of perpendicular plane. The player setups the golf ball under these two strings so his or her eyes are vertically over the top of both strings. Also, by making the distance from the string to tip of each toe the same, the player will be standing with the line of his or her shoulders parallel with strings. Since both strings on top and bottom are in the same vertical plane as the ball, the player can check the head and face angle of the putter and make the stroke easily. Lastly, the player will be able to check any deviation in the direction by eye measurement as well.

Since the poles are made from a height adjustable rod and base rod, it is convenient to store and carry the device around since it can be collapsed and made more compact. Also since the hooks are rotatable on the rods on the top and bottom portion of the poles, the strings are automatically directionally aligned with the perpendicular plane since the strings always pass through the centerline of the poles.

Since the bubble level meters are mounted on the poles, the direction of the perpendicular plane can be easily checked. Also, if a plinth is added to base rod, it is easier to adjust the perpendicularity of the device and distance between two poles.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the invention.

I claim:

1. A training device for putting golf balls with a putter, the putter having a striking face, comprising:

a first pole and a second pole, each pole comprised of:
- a top adjustable rod;
- a base rod, the too adjustable rod telescopically coupled to the base rod, a pair of hooks coupled to each pole in a spaced relationship;

a top string connected between one of the hooks of each pair of hooks coupled to each pole and extending between the first and second poles when the first and second poles are position in a separated configuration from each other;

a bottom string connected between the other one of the hooks of each pair of hooks coupled to each pole and extending between the first and second poles when the first and second poles are positioned in a separated configuration from each other, the bottom string being positioned above the ground and above a golf ball placed on the ground, the top string being positioned above the bottom string to provide a sighting line between the top and bottom strings to define the line of swing of the putter and a line perpendicular to the striking face of the putter, the first and second poles being vertically aligned with respect to the ground, a base assembly coupled to the base rod, the base assembly providing support for the corresponding pole and having an opening diametrically extending through the base assembly to allow free passage of the golf ball therethrough.

2. The training device of claim 1 where each of the hooks are rotatably coupled to their corresponding poles so that the line of the top and bottom strings connected to the hooks extends through the center of the first and second poles.

3. The training device of claim 1 where the base assembly is comprised of a plinth coupled to the base rod and a plurality of legs coupled to the base rod, the opening being diametrically defined through the plinth and straddled by the legs.

4. The training device of claim 1 further comprising a level coupled to each pole to facilitate vertical alignment of each pole.

5. The training device of claim 4 where the level is a bubble level mounted on the top of each top adjustable rod.

6. The training device of claim 1 further comprising a base assembly coupled to the base rod for staking the pole to the ground.

7. The training device of claim 6 further comprising a plurality of adjusting rods coupled to the base assembly for orienting the base assembly with respect to the ground.

8. The training device of claim 1 further comprising a scale defined on each top adjustable rod to permit repeatable height adjust of the first and second poles.

9. A training device for putting golf balls with a putter, the putter having a striking face, comprising:

a first pole;

a second pole;

a pair of hooks rotatably coupled to each pole in a spaced relationship on the pole;

a top string connected between one of the rotatable hooks of each pair of rotatable hooks coupled to each pole and extending between the first and second poles when the first and second poles are positioned in a separated configuration from each other; and a bottom string connected between the other one of the rotatable hooks of each pair of rotatable hooks coupled to each pole and extending between the first and second poles when the first and second poles are position in a separated configuration from each other, the bottom string being positioned above the around and above a golf ball placed on the ground, the top string being positioned above the bottom string to provide a sighting line between the top and bottom strings to define the line of swing of the putter and a line perpendicular to the striking face of the putter, the first and second poles being vertically aligned with respect to the ground, corresponding pairs of the rotatable hooks rotating on the poles so that the line of the top and bottom strings connected to the hooks extends through the center of the first and second poles, where the base assembly includes an opening to allow passage of the golf ball therethrough.

10. The training device of claim 9 where the first and second poles are fixed, nonadjustable rods.

11. The training device of claim 9 where the first and second poles are telescopic, adjustable rods.

12. The training device of claim 9 further comprising a base assembly coupled to the bottom end of each pole for staking the pole to the ground.

13. The training device of claim 9 further comprising a base assembly coupled to the bottom end of each pole for providing a stable platform for holding the pole on flooring.

* * * * *